US006945267B1

(12) United States Patent
Tedona

(10) Patent No.: US 6,945,267 B1
(45) Date of Patent: Sep. 20, 2005

(54) SELF-RESTARTING POOL COVER SIPHON

(75) Inventor: Joseph J. Tedona, Hillsdale, NJ (US)

(73) Assignee: Semco and Tedona Products L.P., Fair Lawn, NJ (US)

( * ) Notice: Subject to any disclaimer, the term of this patent is extended or adjusted under 35 U.S.C. 154(b) by 0 days.

(21) Appl. No.: 10/805,794

(22) Filed: Mar. 22, 2004

(51) Int. Cl.[7] ..... F04F 10/00
(52) U.S. Cl. ..... 137/14; 137/132; 137/143; 137/150
(58) Field of Search ..... 137/14, 132, 143, 137/150

(56) References Cited

U.S. PATENT DOCUMENTS 459,838 A * 9/1891 Hayden ..... 137/132
1,274,578 A * 8/1918 Nicholson ..... 137/143
3,750,691 A * 8/1973 Lidolph ..... 137/142
4,834,138 A 5/1989 Dellasso

* cited by examiner

*Primary Examiner*—Gerald A. Michalsky
(74) *Attorney, Agent, or Firm*—Richard M. Goldberg

(57) ABSTRACT

A self-restarting pool cover siphon includes a weighted housing placed on a pool cover having water thereon, the housing having a hollow interior and openings through which water can enter, a tube in fluid communication with the hollow interior and through which water drains, the tube bent into a loop and having an opening between opposite ends thereof at an upper position of the loop, and a differential pressure causing device removably connected to the opposite end of the tube for initially causing a differential pressure in the tube to cause water in the housing to drain through the tube, and thereafter being removed from the opposite end of the tube, wherein additional water on the pool cover will cause water remaining in the loop to pass the opening in the loop to re-prime the siphon and cause drainage of the water from the pool cover.

11 Claims, 2 Drawing Sheets

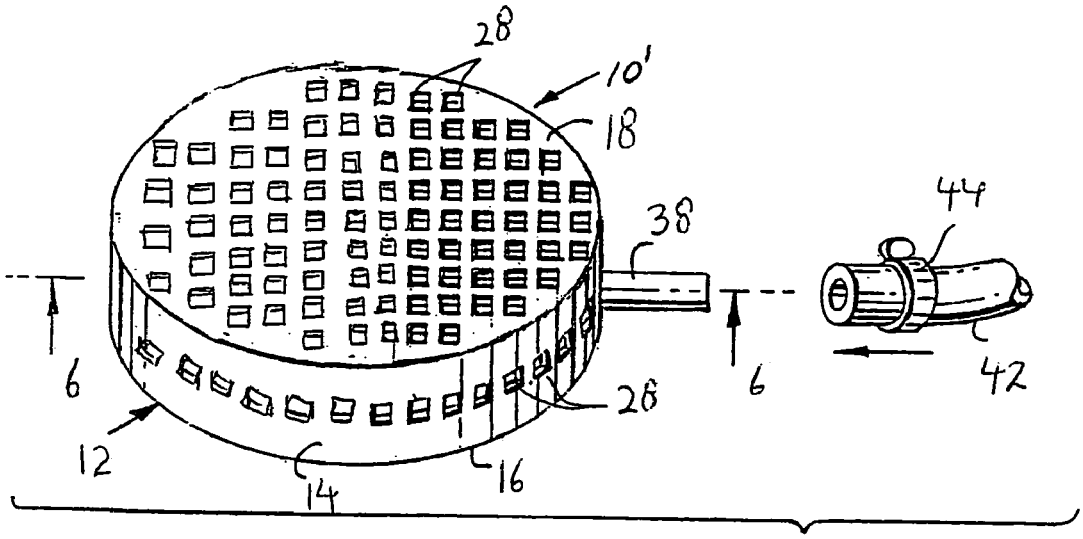
FIG. 5
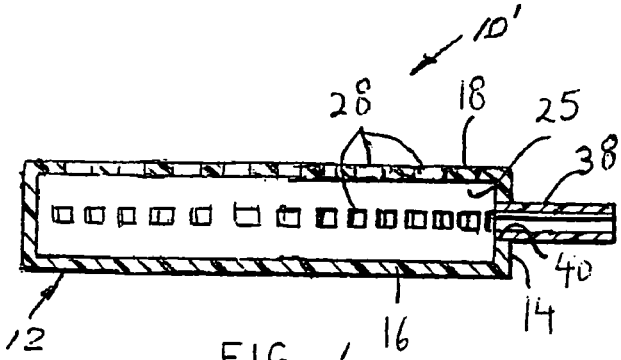
FIG. 6
FIG. 7
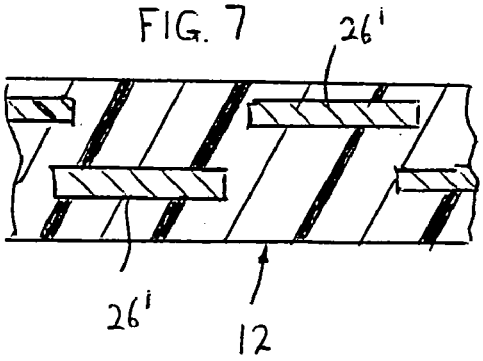

SELF-RESTARTING POOL COVER SIPHON

BACKGROUND OF THE INVENTION

The present invention relates generally to swimming pool cover siphons, and more particularly, to a self-restarting swimming pool cover siphon.

Outdoor swimming pools are provided with covers when not in use, in order to prevent leaves and the like from entering the water in the pool. However, a problem that results is that rain water, melted snow, etc. deposit on top of the pool cover. This can cause undue stress and possible tearing of the pool cover.

For this reason, it is known to provide a siphon on top of the pool cover, which removes the water deposited thereon. An example of such a siphon is disclosed in U.S. Pat. No. 4,834,138 to Dellasso, the entire disclosure of which is incorporated herein by reference. Specifically, a sump screen device is placed on top of the pool cover, and has a hose connected thereto and extending to a check valve and bulb pump. In operation, the sump pump device is placed as near the center portion of the rain water that is accumulated on the pool cover. The operator squeezes the bulb to cause a differential in pressure and the rain water will then begin to flow through openings in the housing of the sump screen device, and out through the hose. When the rain water is removed, the pump will stop operating.

However, after a new rainfall, it is necessary for the operator to re-prime the pump to start the removal operation, that is, the operator must squeeze the bulb each time in order to start the operation. This becomes burdensome over time. Further, if the operator is away for an extended period of time, for example, during the winter, the rainwater will accumulate and the pump will not be operative since there will be no one to prime the pump by squeezing the bulb.

SUMMARY OF THE INVENTION

Accordingly, it is an object of the present invention to provide a self-restarting pool cover siphon that overcomes the aforementioned problems.

It is another object of the present invention to provide a self-restarting pool cover siphon that empties accumulated rainwater from the top of a pool cover.

It is still another object of the present invention to provide a self-restarting pool cover siphon in which the pump is automatically started when the rainwater reaches a certain level.

It is yet another object of the present invention to provide a self-restarting pool cover siphon which does not require an operator to continually re-prime the pump.

It is a further object of the present invention to provide a self-restarting pool cover siphon that is easy to use and economical to manufacture.

In accordance with an aspect of the present invention, a self-restarting pool cover siphon includes a housing adapted to be placed on top of a pool cover where water drainage is desired, the housing having a hollow interior and at least one opening through which water on the pool cover can drain into the hollow interior, the housing being weighted to remain on the pool cover, a tube having one end secured to the housing and in fluid communication with the hollow interior and an opposite open end through which water traveling through the tube drains, the tube adapted to be bent to form a loop therein, and the tube having an opening between the opposite ends thereof to be positioned at an upper position of the loop, and a differential pressure causing device removably connected to the opposite end of the tube for initially causing a differential pressure in the tube to cause the water in the housing to drain from the pool cover through the housing and the tube, and thereafter being removed from the opposite end of the tube, wherein additional water deposited on the pool cover will cause water remaining in the loop to pass by the opening in the loop to re-prime the siphon and cause drainage of water from the pool cover without further use and actuation of the differential pressure causing device.

The opening in the loop is adjusted to a position corresponding to a maximum height of water on top of the pool cover.

A holding device releasably holds the loop in its loop configuration. Alternatively, the loop is fixed in its loop configuration.

In one embodiment, the hollow interior of the housing is separated into first and second compartments by a divider wall, the at least one opening being in fluid communication only with the first compartment, and the second compartment including a material to weigh down the housing. In another embodiment, the housing includes at least one wall having a material embedded therein to weigh down the housing.

Preferably, the differential pressure causing device includes a check valve and bulb pump assembly.

In accordance with another aspect of the present invention, a method for siphoning water from a top of a pool cover, includes the steps of placing a housing on top of the pool cover where water drainage is desired, the housing having a hollow interior and at least one opening through which water on the pool cover can drain into the hollow interior, the housing being weighted to remain on the pool cover. One end of a tube having opposite ends and an opening between the opposite ends, is secured to the housing in fluid communication with the hollow interior. A loop is formed in the tube such that the opening in the tube is positioned at an upper position of the loop, and the position of the opening is adjusted to a position substantial equal to a maximum height of water on top of the pool cover. The opening in the tube is then covered, and a differential pressure causing device secured to the opposite end of the tube is actuated to initially cause a differential pressure in the tube, wherein water from the top of the pool cover which has drained into the housing is siphoned through the tube and removed at the opposite end of the tube. Thereafter, the differential pressure causing device is removed from the tube, and the opening in the tube is uncovered, wherein additional water deposited on the pool cover will cause water remaining in the loop to pass by the opening in the loop to re-prime the siphon and cause drainage of water from the pool cover without further use and actuation of the differential pressure causing device.

The above and other objects, features and advantages of the invention will become readily apparent from the following detailed description thereof which is to be read in connection with the accompanying drawings.

BRIEF DESCRIPTION OF THE DRAWINGS

FIG. 5 is an enlarged perspective view of a self-restarting pool cover siphon according to another embodiment of the present invention;

FIG. 6 is a cross-sectional view of FIG. 5, taken along line 6—6 thereof; and FIG. 7 is an enlarged cross-sectional view of a portion of the housing of FIG. 5, showing the weight means therein.

DETAILED DESCRIPTION

Figure 1:
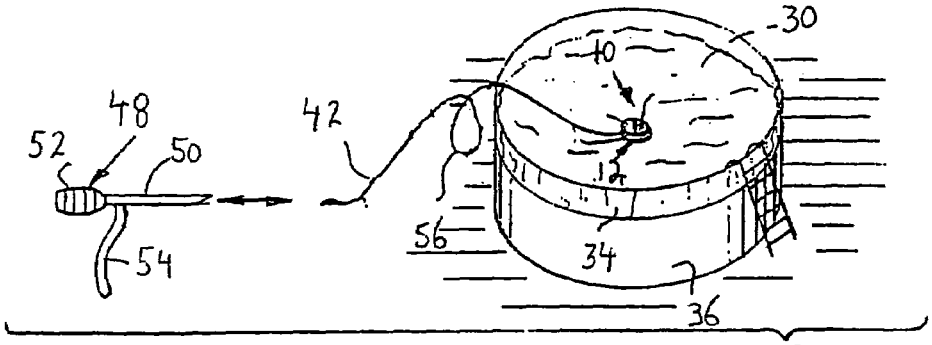
FIG. 1 is a perspective view of a self-restarting pool cover siphon according to the present invention, shown in operation with a pool cover.

Referring now to the drawings in detail, and initially to FIGS. 1–4, a self-restarting pool cover siphon 10 according to the present invention include a generally cylindrical housing 12, although the present invention is not limited to this shape, and housing 12 can have a square, rectangular, oval, etc. shape. Housing 12 has an annular side wall 14 which is closed at its lower end by a circular bottom wall 16 and is closed at its upper end by a circular top wall 18.

In a first embodiment, the hollow interior of housing 12 is divided in half by a diametrical divider wall 20 so as to define a first semi-cylindrical chamber 22 and a second semi-cylindrical chamber 24. First semi-cylindrical chamber 22 is filled with a heavy material 26, such as a ballast gravel that serves to weigh housing 12 down to prevent housing from moving.

Side wall 14 and top wall 18 which surround second semi-cylindrical chamber 24 each have a plurality of openings 28 therein through which rainwater 30 can enter second semi-cylindrical chamber 24 for removal, as will now be described. Openings 28 provide for input flow of rain water 30 that accumulates in the top of a pool cover 34 covering an outdoor pool 36, while at the same time preventing leaves and other large debris immersed in the water 30 from clogging openings 28 in housing 12 and making it inoperative.

A tube fitting 38 has one end fixedly secured in an opening 40 through that portion of side wall 14 surrounding second semi-cylindrical chamber 24 so as to be in fluid communication therewith. A flexible hose 42 is fitted on the other end of tube fitting 38 and is fastened thereto by an adjustable clamp 44.

When housing 12 is placed on pool cover 34, as shown in FIG. 1, flexible hose 42 extends over the side of outdoor pool 36. A conventional check valve and bulb pump 48 is provided for starting siphon 10, and includes an input tube 50 secured in a squeeze bulb 52, and a flexible discharge tube 54 is fixedly secured at one end to a rear portion of input tube 50.

In accordance with an important aspect of the present invention, flexible hose 42 that extends over the side of outdoor pool 36 is formed into a loop 56 before it continues further to be connected to check valve and bulb pump 48. Loop 56 can be releasably retained in its loop configuration by a clip, tie or any other suitable holding device 59. Alternatively, tube 42 can be permanently deformed into loop 56, either by the consumer or at the factory.

The upper or topmost portion 58 of loop 56 includes an opening 60 that is positioned at a level of rainwater 30 that is desired on pool cover 34.

In operation, housing 12 is placed as near to the center portion of rainwater 30 accumulated on pool cover 34, with the top wall 18 facing upward. The unattached end of flexible hose 42 is depended downward from the side of the pool 36, and tube 50 is forced into the opposite open end of hose 42. Further, topmost portion 58 of loop 56, with opening 60 therein, is positioned at a level that is desired of the rainwater 30 on pool cover 34. Then, the operator covers hole 60 and squeezes bulb 52 to cause a differential in pressure, whereby rainwater 30 begins to flow through openings 28 and out through hose 42 to discharge tube 54. At this time, once the water 30 starts flowing out through discharge tube 54, opening 60 in loop 56 can be uncovered. When the above occurs, pump 48 is then removed and rainwater 30 will continue to flow out from cover 34 of pool 36 until the level of rainwater 30 reaches the level of opening 60.

When the level of rainwater 30 reaches the level of opening 60 in loop 56, the differential pressure is no longer present, so that drainage of rainwater 30 terminates. At this time, water 30 remains in the bottom part of loop 56 which extends at a level below opening 60. In U.S. Pat. No. 4,834,138, when rainwater 30 accumulates again on pool cover 34, it is necessary to reattach check valve and bulb pump 48 to re-prime the pump in order to create the differential to start the flow of rainwater 30 again. However, with the present invention, because of loop 56 and opening 60, when the level of rainwater 30 increases to a level above opening 60, the water pressure of rainwater 30 which enters housing 12 through openings 28, forces a slight amount of rainwater 30 through hose 42. This forces the rainwater 30 in loop 56 to rise up to the position of opening 60. As the rainwater 30 passes opening 60, it causes a suction, which then automatically re-primes and thereby restarts the siphoning action, that is, which creates the necessary pressure differential. Thus, there is no need for a person to re-attach check valve and bulb pump 48, as is necessary with U.S. Pat. No. 4,834,138.

In other words, after a new rainfall, it is not necessary for an operator to re-prime the pump to start the removal operation. For example, if the operator is away for an extended period of time, such as during the winter, the self-priming operation will start the siphon operation, so that the rainwater 30 will not accumulate on pool cover 34.

Figure 2:
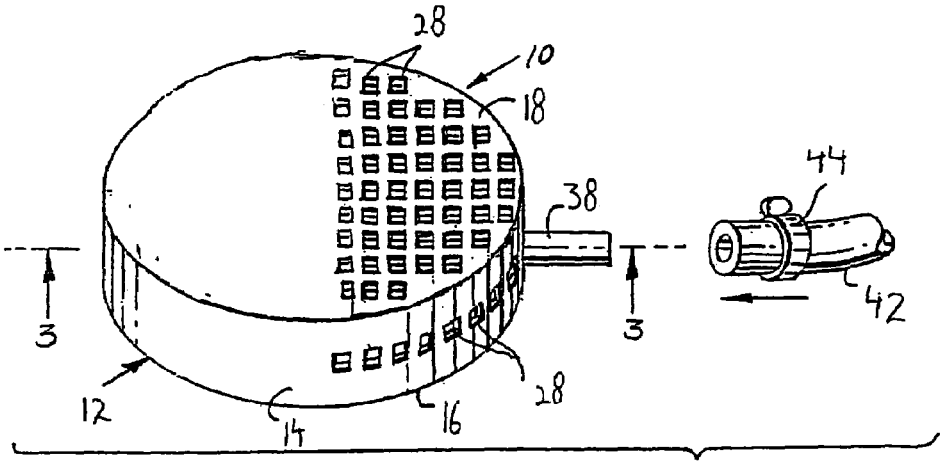
FIG. 2 is an enlarged perspective view of the self-restarting pool cover siphon.
Figure 3:
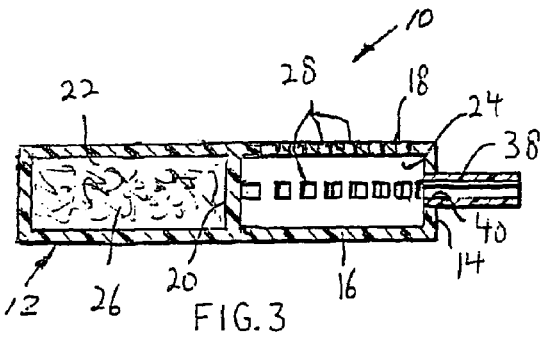
FIG. 3 is a cross-sectional view of FIG. 2, taken along line 3—3 thereof.
Figure 4:
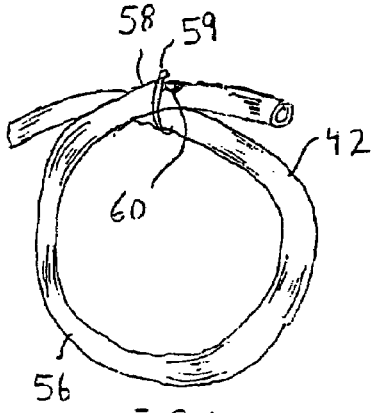
FIG. 4 is an enlarged perspective view of the loop formed on the flexible hose extending from the housing.

Referring now to FIGS. 5–7, a self-restarting pool cover siphon 10' according to a second embodiment of the present invention is generally constructed in the same manner as self-restarting pool cover siphon 10 of FIGS. 1–3, and the same reference numerals are used to describe the same. However, with self-restarting pool cover siphon 10', there is no divider wall 20 and openings 28 are provided on the entire side wall 14 and top wall 18, so that the entire interior 25 of housing 12 is used for drainage of rain water 30. In order to weigh down housing 12, a metal, bonded sand or other heavy material 26' is molded into the plastic of housing 12. Of course, if it is desired to retain the area of only one-half of interior 25, that is, equal to second semi-cylindrical chamber 24, the size of housing 12 can be reduced.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A self-restarting pool cover siphon comprising:

a housing adapted to be placed on top of a pool cover where water drainage is desired, the housing having a hollow interior and at least one opening through which water on the pool cover can drain into the hollow interior, the housing being weighted to remain on the pool cover, a tube having one end secured to said housing and in fluid communication with the hollow interior and an opposite open end through which water traveling through the tube drains, the tube adapted to be bent to form a loop therein, and the tube having an opening between the opposite ends thereof to be positioned at an upper position of the loop, and a differential pressure causing device removably connected to the opposite end of the tube for initially causing a differential pressure in the tube to cause the water in the housing to drain from said pool cover through the housing and said tube, and thereafter being removed from the opposite end of the tube, wherein additional water deposited on the pool cover will cause water remaining in the loop to pass by the opening in the loop to re-prime the siphon and cause drainage of water from the pool cover without further use and actuation of the differential pressure causing device.

2. A self-restarting pool cover siphon according to claim 1, wherein the opening in the loop is adjusted to a position corresponding to a maximum height of water on top of the pool cover.

3. A self-restarting pool cover siphon according to claim 1, further comprising a holding device for releasably holding the loop in its loop configuration.

4. A self-restarting pool cover siphon according to claim 1, wherein the loop is fixed in its loop configuration.

5. A self-restarting pool cover siphon according to claim 1, wherein the hollow interior of the housing is separated into first and second compartments by a divider wall, the at least one opening being in fluid communication only with the first compartment, and the second compartment including a material to weigh down the housing.

6. A self-restarting pool cover siphon according to claim 1, wherein the housing includes at least one wall having a material embedded therein to weigh down the housing.

7. A self-restarting pool cover siphon according to claim 1, wherein the differential pressure causing device includes a check valve and bulb pump assembly.

8. A method for siphoning water from a top of a pool cover, comprising the steps of:

placing a housing on top of the pool cover where water drainage is desired, the housing having a hollow interior and at least one opening through which water on the pool cover can drain into the hollow interior, the housing being weighted to remain on the pool cover, securing one end of a tube having opposite ends and an opening between the opposite ends, to said housing in fluid communication with the hollow interior, forming a loop in the tube such that the opening in the tube is positioned at an upper position of the loop, adjusting the position of the opening to a position substantial equal to a maximum height of water on top of the pool cover, covering the opening in the tube, actuating a differential pressure causing device secured to the opposite end of the tube to initially cause a differential pressure in the tube, wherein water from the top of the pool cover which has drained into the housing is siphoned through said tube and removed at said opposite end of the tube, thereafter removing the differential pressure causing device from the tube, and uncovering the opening in the tube wherein additional water deposited on the pool cover will cause water remaining in the loop to pass by the opening in the loop to re-prime the siphon and cause drainage of water from the pool cover without further use and actuation of the differential pressure causing device.

9. A method according to claim 8, wherein said differential pressure causing device includes a check valve and bulb pump assembly.

10. A method according to claim 8, wherein said step of forming a loop in the tube includes the step of securing said flexible hose to maintain the loop in the loop configuration.

11. A method according to claim 8, wherein said step of forming a loop in the tube includes the step of preforming the loop during manufacture thereof.

* * * * *